US009177535B2

(12) United States Patent
Suzuki

(10) Patent No.: US 9,177,535 B2
(45) Date of Patent: Nov. 3, 2015

(54) HAMMER DEVICE FOR KEYBOARD INSTRUMENT

(71) Applicant: KABUSHIKI KAISHA KAWAI GAKKI SEISAKUSHO, Hamamatsu-shi, Shizuoka-ken (JP)

(72) Inventor: Akihiro Suzuki, Hamamatsu (JP)

(73) Assignee: KABUSHIKI KAISHA KAWAI GAKKI SEISAKUSHO, Hamamatsu-shi (JP)

( * ) Notice: Subject to any disclaimer, the term of this patent is extended or adjusted under 35 U.S.C. 154(b) by 0 days.

(21) Appl. No.: 14/518,551

(22) Filed: Oct. 20, 2014

(65) Prior Publication Data

US 2015/0114202 A1 Apr. 30, 2015

(30) Foreign Application Priority Data

Oct. 31, 2013 (JP) ..... 2013-226780
Oct. 31, 2013 (JP) ..... 2013-226781

(51) Int. Cl.
*G10C 3/12* (2006.01)
*G10C 3/18* (2006.01)

(52) U.S. Cl.
CPC ... *G10C 3/18* (2013.01); *G10C 3/12* (2013.01)

(58) Field of Classification Search
CPC ..... G10C 3/18; G10C 3/12
See application file for complete search history.

(56) References Cited

U.S. PATENT DOCUMENTS 5,585,582 A * 12/1996 Stanwood ..... G10C 3/12 84/432
5,945,617 A * 8/1999 Niitsuma ..... G10C 3/12 84/423 R
8,969,698 B1 * 3/2015 Suzuki ..... G10C 3/12 84/436
9,082,372 B2 * 7/2015 Suzuki ..... G10C 3/12 84/236
2015/0068384 A1 * 3/2015 Suzuki ..... G10H 1/34 84/243
2015/0114202 A1 * 4/2015 Suzuki ..... G10C 3/18 84/236

FOREIGN PATENT DOCUMENTS

JP 2002169562 A * 6/2002
JP 2004-341321 12/2004
JP 2011-022472 2/2011

* cited by examiner

*Primary Examiner* — Robert W Horn
(74) *Attorney, Agent, or Firm* — Christie, Parker & Hale, LLP

(57) ABSTRACT

A hammer device for a keyboard instrument, enabling improvement of efficiency and yield, in manufacturing weights to be attached to each hammer body while suppressing an increase in manufacturing cost. Each hammer includes a hammer body having a weight mounting portion, a common weight attached to one of left and right side surfaces of the weight mounting portion, and an adjustment weight having a length set according to a touch weight required by the associated key and attached to the other of the left and right side surfaces of the weight mounting portion. A chassis has a plurality of partition parts, and on the left and right surfaces of the hammer body, there are formed left and right opposed protrusions, respectively, each of which protrudes outward of the weight and is opposed to a partition part associated therewith via a predetermined clearance.

6 Claims, 7 Drawing Sheets

HAMMER DEVICE FOR KEYBOARD INSTRUMENT

CROSS-REFERENCE TO RELATED APPLICATION(S)

This application claims priority to and the benefit of Japanese Patent Application No. 226780/2013, filed on Oct. 31, 2013 and Japanese Patent Application No. 226781/2013, filed on Oct. 31, 2013, the disclosures of which are hereby incorporated by reference in their entirety.

BACKGROUND OF THE INVENTION

1. Field of the Invention

The present invention relates to a hammer device for a keyboard instrument, which is applied to a keyboard instrument, such as an electronic piano, and is configured to impart touch weight by a hammer pivotally moved in a manner interlocked with key depression.

2. Description of the Related Art

As a hammer device for a keyboard instrument, such as an electronic piano, there have conventionally been known ones disclosed e.g. in Japanese Laid-Open Patent Publications (Kokai) No. 2011-22472 and No. 2004-341321, respectively. Each of the keyboard devices to which these hammer devices are applied, respectively, is comprised of a plurality of keys each extending in a front-rear direction, a plurality of hammers provided in association with the respective keys, and a keyboard chassis for pivotally supporting the keys and the hammers thereon in a state arranged side by side in a left-right direction.

The hammer disclosed in Japanese Laid-Open Patent Publication (Kokai) No. 2011-22472 is comprised of a hammer body formed as a resin molded article and a metal weight detachably attached to the hammer body. The hammer body is formed in a predetermined shape extending in the front-rear direction, and has a front half thereof pivotally supported on the keyboard chassis and a rear half thereof formed with a weight mounting portion having a predetermined shape. On the other hand, the weight is formed by a metal plate extending in the front-rear direction. The weight has a front half formed with a mounted portion having a shape complementary to the weight mounting portion of the hammer body, and extends from the mounted portion to a location close to the rear end of the keyboard chassis. The weight is configured such that it can be fixed to the hammer body by being slid forward in a state in which the mounted portion is fitted in the weight mounting portion of the hammer body, and can be removed from the hammer body by being slid rearward from the state fixed to the hammer body.

The keyboard chassis is formed as a molded article made of a synthetic resin, such as an ABS resin. The keyboard chassis has a large number of vertical ribs formed so as to ensure strength and rigidity of the keyboard chassis itself while maintaining a space for pivotal motion of each hammer which is performed in a manner interlocked with key depression. Specifically, each of the ribs is formed in a plate shape having a predetermined thickness in the left-right direction and is disposed in a manner separating hammers adjacent to each other in the left-right direction.

On the other hand, the hammer disclosed in Japanese Laid-Open Patent Publication (Kokai) No. 2004-341321 has a hammer body comprised of a resin holder and a metal base plate and two weight plates attached to left and right side surfaces of the hammer body, respectively. The hammer body is formed in a general S shape in side view by insert-molding the metal base plate in the resin holder. At predetermined locations on a front end of the metal base plate, there are formed a rivet hole and two positioning holes, respectively, each of which extends through the metal base plate in the left-right direction. On the other hand, the two weight plates are formed by respective metal plates having the same outer shape. Each of the weight plates has two positioning projections and rivet holes formed at respective predetermined locations on a hammer body-side surface. The two weight plates are fixed to the hammer body by sandwiching the metal base plate from both left and right sides and riveting rivets inserted through the rivet holes of the two weight plates and the metal base plate with each of the positioning projections fitted in an associated one of the positioning holes.

In an electronic piano having the hammer device disclosed in Japanese Laid-Open Patent Publication (Kokai) No. 2011-22472 or No. 2004-341321, the weight of each of hammers associated with respective keys in a lower-pitch range is made heavier than that of each of hammers associated with respective keys in a higher-pitch range so as to obtain touch weight of a keyboard closely analogous to touch weight of an acoustic piano during musical performance. For this reason, in general, in the hammer device, common hammer bodies are used for respective hammers, whereas a plurality of types of weights or weight plates different in shape from each other are used make the hammers different in weight according to each pitch range.

However, in the hammer device disclosed in Japanese Laid-Open Patent Publication (Kokai) No. 2011-22472, the shape of the mounted portion of the weight is common between the hammers, but it is required to form a plurality of protrusions at respective predetermined locations on the periphery of the mounted portion of the weight so as to facilitate removal of the weight from the hammer body, which makes the shape of the mounted portion complicated. Further, it is required to form a portion of the weight continuous with the mounted portion and extending rearward such that the shape of the portion largely differs on a pitch range basis. On the other hand, in the hammer device disclosed in Japanese Laid-Open Patent Publication (Kokai) No. 2004-341321, the two weight plates of each hammer are common in outer shape, but it is required to form the two positioning projections such that they project in different directions. In addition, the two weight plates of each hammer are required to be formed such that their shape largely differs on a pitch range basis.

As described above, the weight or the weight plate (hereinafter generically referred to as "the weight) employed in the hammer device disclosed in Japanese Laid-Open Patent Publication (Kokai) No. 2011-22472 or No. 2004-341321 has a complicated shape, and multiple types of weights are needed for a whole keyboard instrument. For this reason, multiple types of metal molds which enable a metal plate to be cut into complicated shapes are required so as to manufacture the above-mentioned weights, which results in increases manufacturing costs. In addition, since the shape of the weight is complicated, there is a fear that manufacturing efficiency and yield are lower.

Further, assuming that the electronic piano is stored in a room in an upright position in which the left and right sides thereof are in vertically opposite positions, if the room temperature becomes very high e.g. in summer, the keyboard chassis made of a synthetic resin and the hammer body tend to be bent downward due to the self weight of the keyboard chassis and the weight of the hammers, which can cause deformation of the keyboard chassis and the hammer body. In this case, there is a possibility that noise is generated during musical performance e.g. due to rubbing of the metal weight of a hammer in pivotal motion against an associated one of the synthetic resin-made vertical ribs of the keyboard chassis. To avoid this, during manufacturing of the electronic piano, a guide tape having lubricity is wound around a portion of the weight of each hammer, which can rub against a vertical rib associated therewith, for example, whereby noise generated due to rubbing of the weight of the hammer against the keyboard chassis is largely reduced.

However, in general, the keyboard device of an electronic piano is provided with the same number (e.g. eighty-eight) of hammers as the number of keys. For this reason, when it is required to wind the guide tape around the weight of each of all the hammers, the tape winding work takes much time and labor and necessitates the guide tape, which causes an increase in manufacturing cost.

SUMMARY OF THE INVENTION

It is a first object of the present invention to provide a hammer device for a keyboard instrument, which makes it possible to improve efficiency and yield in manufacturing weights to be attached to each hammer body, while suppressing an increase in manufacturing cost.

Further, it is a second object of the present invention to provide a hammer device for a keyboard instrument, which makes it possible not only to prevent generation of noise while ensuring smooth pivotal motion of a hammer, but also to achieve reduction of manufacturing cost.

To attain the first object, in a first aspect of the present invention, there is provided a hammer device for a keyboard instrument, which includes a plurality of hammers each provided in association with an associated one of a plurality of keys, and in which each of the hammers is pivotally moved in a manner interlocked with depression of the associated key to thereby impart touch weight to the key, wherein each of the hammers comprises a hammer body extending in a front-rear direction, the hammer body having a front half thereof pivotally supported and a rear half thereof formed with a weight mounting portion, a first weight extending in the front-rear direction, the first weight being formed common in shape and size to all the hammers, and attached to one of left and right side surfaces of the weight mounting portion, and a second weight extending in the front-rear direction, the second weight being formed to have a length in the front-rear direction which is shorter than a length in the front-rear direction of the first weight and is set according to a touch weight required by the associated key, and attached to the other of the left and right side surfaces of the weight mounting portion.

With the construction of the hammer device, each of the hammers has the hammer body and the first and second weights all of which extend in the front-rear direction, and the first and second weights are attached to the respective left and right side surfaces of the weight mounting portion formed on the rear half of the hammer body which has the front half thereof pivotally supported. Further, the first weights of the respective hammers are formed identical in shape and size to each other, so that it is possible to manufacture the first weights with ease, using a single metal mold or the like. On the other hand, each of the second weights of the respective hammers is formed to have a length in the front-rear direction which is shorter than that of the first weight and is set according touch weight required by an associated one of the keys.

By attaching the first and second weights to the hammer body as mentioned above, more than half of weight required of the hammer is provided by the first weight and the weight required of the hammer is adjusted by the second weight, so that differently from the prior art in which a weight having a complicated external shape is used, it is possible to improve manufacturing efficiency and yield while suppressing an increase in manufacturing cost.

Preferably, the first weight and the second weight have respective mounted portions formed to be identical in construction to each other and attached to the weight mounting portion of the hammer body.

With this construction, since the mounted portions of the respective first and second weights, which are attached to the weight mounting portion of the hammer body, are formed identical in construction to each other, it is possible to form the first and second weights of all the hammers with high efficiency, using a single metal mold or the like.

More preferably, the first weight and the second weight are formed by respective metal plates identical in thickness and width to each other.

With this construction, since the first and second weights are formed by respective metal plates identical in thickness and width to each other, it is possible to further enhance efficiency and yield in manufacturing the two weights. For example, a long metal plate having the same thickness and width as those of the two weights is prepared in advance. Then, the mounted portion is formed in the metal plate e.g. by presswork, and the metal plate is cut into a desired length, whereby the first and second weights can be manufactured with relative ease.

To attain the second object, in a second aspect of the present invention, there is provided a hammer device for a keyboard instrument, which includes a plurality of hammers each provided in association with an associated one of a plurality of keys, and is pivotally supported on a chassis in a state arranged side by side in a left-right direction, and in which each of the hammers is pivotally moved in a manner interlocked with depression of the associated key to thereby impart touch weight to the key, wherein the chassis is formed as a molded article which is made of a synthetic resin, and has a plurality of partition parts each provided between each pair of hammers adjacent to each other in the left-right direction, and wherein each of the hammers comprises a hammer body formed as a molded article which is made of a synthetic resin and extends in a front-rear direction, and is pivotally supported on the chassis via a support formed at a predetermined location of a front half thereof, and a weight extending in the front-rear direction, the weight being attached to a rear half of the hammer body, and wherein on left and right side surfaces of the hammer body, there are formed, between the support and the weight, left and right opposed protrusions which protrude outward of the weight and are each opposed to an associated one of the partition parts via a predetermined clearance.

With the construction of the hammer device, the hammers associated with the respective keys are pivotally supported on the chassis formed as a molded article of a synthetic resin, in a manner arranged side by side in the left-right direction. The partition parts of the chassis are each formed between each pair of hammers adjacent to each other in the left-right direction. Further, the hammer body of each of the hammers is formed as a molded article which is made of a synthetic resin and extends in the front-rear direction. The hammer body is pivotally supported on the chassis via a support formed at a predetermined location of the front half of the hammer body, and the weight extending in the front-rear direction is attached to the rear half of the hammer body. In addition, there are formed, between the support and the weight, left and right opposed protrusions which protrude outward of the weight.

The left and right opposed protrusions protrude outward, i.e. leftward and rightward, respectively, and are each opposed via the predetermined clearance to the associated partition part of the chassis. With this, in a case where a hammer is brought into abutment with an associated partition part of the chassis e.g. due to deformation of the chassis, since the clearance between the opposed protrusion and the partition part is set to be smaller than that between the weight and the partition part, the opposed protrusion of the hammer body comes into abutment with the partition part, with precedence over the weight, and therefore it is possible to avoid abutment of the weight of the hammer against the chassis. This makes it possible to prevent generation of noise due to abutment of the weight of the hammer against the chassis while ensuring smooth pivotal motion of the hammer. Further, it is not required to wind guide tapes around the respective weights of the hammer as in the prior art, so that it is possible to achieve reduction of manufacturing cost.

Preferably, each of the opposed protrusions is formed in an arcuate shape in side view, which extends along a concentric circle about the support.

With this construction, each of the opposed protrusions has the above-described arcuate shape in side view, so that even when the opposed protrusion is brought into sliding contact with the partition part of the chassis during pivotal motion of the hammer, it is possible to reduce a frictional force generated between the opposed protrusion and the chassis, to thereby ensure smooth pivotal motion of the hammer.

More preferably, each of the opposed protrusions is formed with a groove for retaining lubricant.

With this construction, when lubricant is applied to the left and right opposed protrusions of the hammer body, part of the lubricant enters the grooves of the respective opposed protrusions to be retained therein. This makes it possible to maintain, over a long time period, a state in which the lubricant is held in each of the opposed protrusions of the respective left and right side surfaces. Therefore, when the hammer is pivotally moved in a manner interlocked with key depression, even if the opposed protrusion of the hammer body is brought into sliding contact with the partition part of the chassis, it is possible to ensure smooth pivotal motion of the hammer while preventing generation of noise due to the sliding contact.

The above and other objects, features, and advantages of the present invention will become more apparent from the following detailed description taken in conjunction with the accompanying drawings.

BRIEF DESCRIPTION OF THE DRAWINGS

FIGS. 9A to 9F are views useful in explaining weights of the hammer, in which:

FIG. 9A shows a common weight in a state attached to the hammer body; and

FIGS. 9B to 9F show adjustment weights in a state before being attached to the hammer body.

DETAILED DESCRIPTION OF PREFERRED EMBODIMENTS

Figure 1:
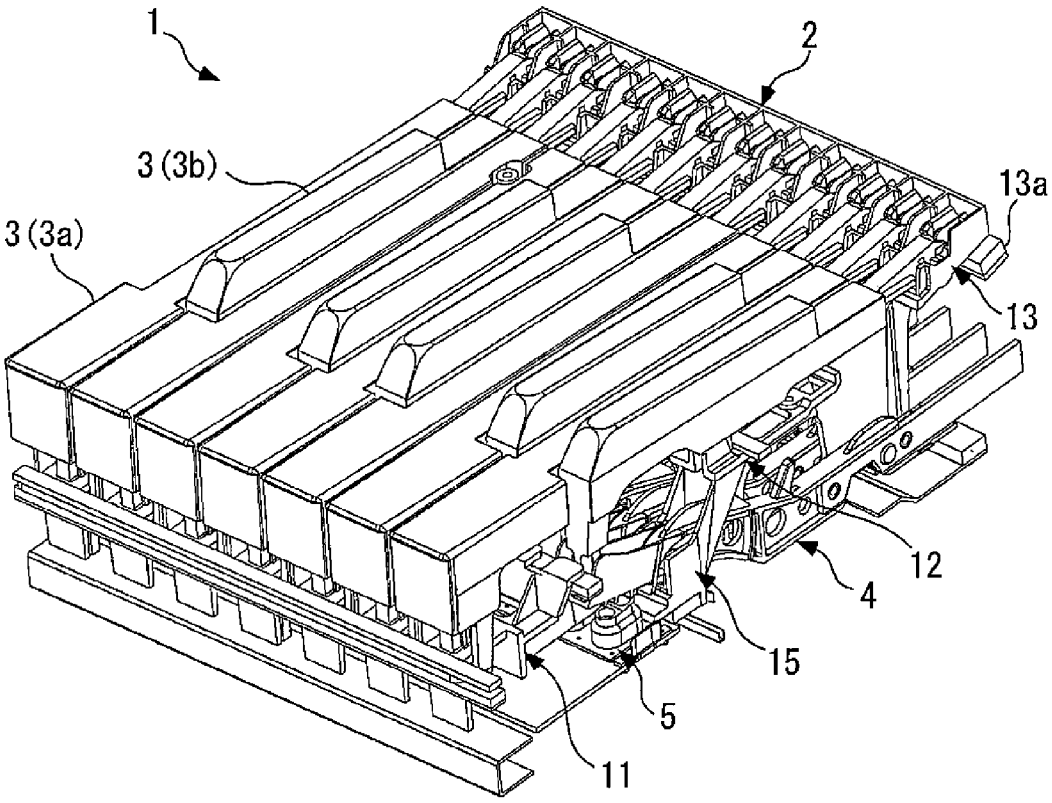
FIG. 1 is a perspective view of a keyboard device (for one octave section) of an electronic piano to which is applied a hammer device according to an embodiment of the present invention.
Figure 2A:
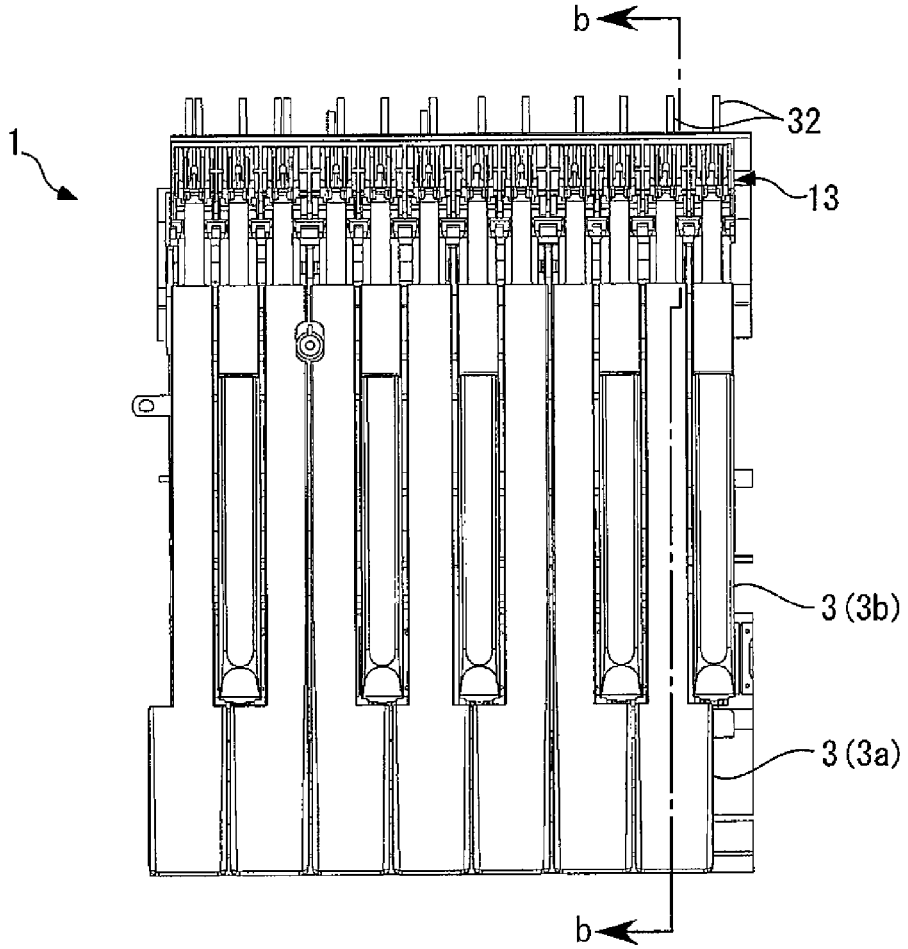
FIG. 2A is a plan view of the keyboard device shown in FIG. 1.
Figure 2B:
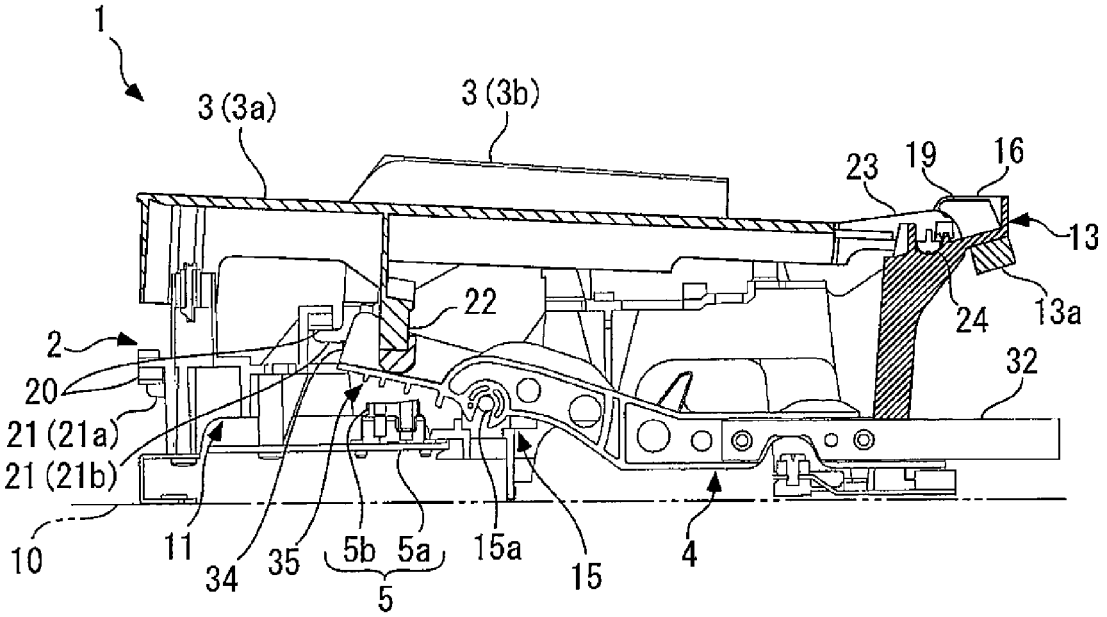
FIG. 2B is a cross-sectional view of the keyboard device shown in FIG. 1 taken on line b-b of FIG. 2A.

The present invention will now be described in detail with reference to the drawings showing a preferred embodiment thereof. FIGS. 1, 2A, and 2B show a keyboard device, in a key-released state, of an electronic piano to which is applied a hammer device according to the embodiment. Note that FIGS. 1, 2A, and 2B show only a one-octave section of the keyboard device.

As shown in FIGS. 1, 2A, and 2B, the keyboard device 1 is comprised of a keyboard chassis 2 (chassis), a plurality of keys 3 including white keys 3*a* and black keys 3*b* pivotally mounted on the keyboard chassis 2 and arranged in the left-right direction, a plurality of hammers 4 pivotally mounted on the keyboard chassis 2 in association with the respective keys 3, and a key switch 5 for detecting key depression information of each key 3.

Figure 3A:
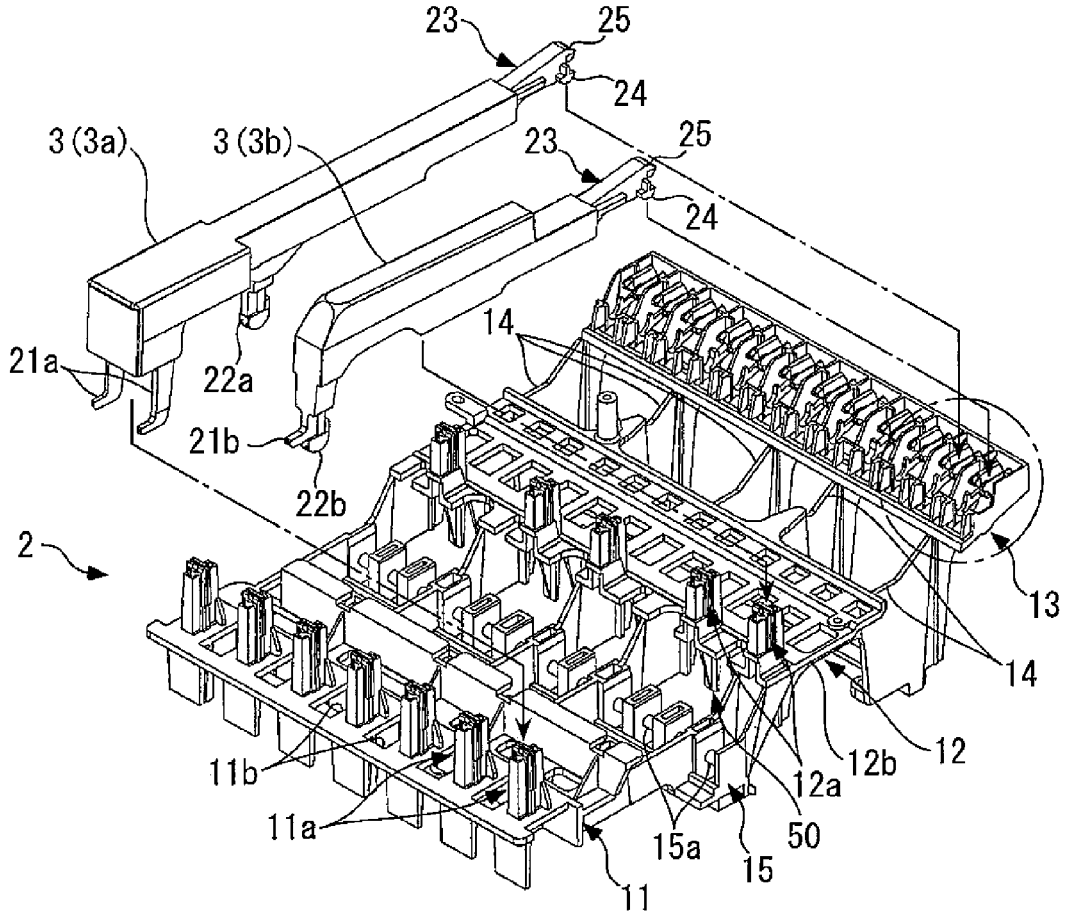
FIG. 3A is an exploded perspective view of a keyboard chassis and keys of the keyboard device in FIG. 1.

The keyboard chassis 2 is formed as a resin molded article which is made e.g. by injection molding of a predetermined resin material (e.g. an ABS resin) into a predetermined shape. As shown in FIG. 3A, the keyboard chassis 2 has a front part 11, a central part 12, and a rear part 13 each extending in the left-right direction as a whole. The front part 11, the central part 12, and the rear part 13 are connected to each other by a plurality of ribs 14 disposed with an appropriate spacing therebetween in the left-right direction. Note that in the following description, the front part 11, the central part 12, and the rear part 13 of the keyboard chassis 2 will be referred to as "the chassis front 11", "the chassis center 12", and "the chassis rear 13", respectively.

The chassis front 11 serves to guide the white keys 3*a*. The chassis front 11 has a plurality of (seven in FIG. 3A) white key guide parts 11*a* erected thereon and each inserted into an associated one of the white keys 3*a* from below so as to prevent lateral swing of the white key 3*a*. Further, the chassis front 11 has engagement holes 11*b* and 11*b*, vertically extending therethrough, formed on the respective left and right sides of each of the white key guide parts 11*a*. A pair of left and right upper limit position regulation parts 21*a* and 21*a*, referred to hereinafter, of the white key 3*a* are engaged with the respective engagement holes 11*b* and 11*b* in a state inserted therethrough.

The chassis center 12 serves to guide the black keys 3*b*. Similarly to the chassis front 11, the chassis center 12 has a plurality of (five in FIG. 3A) black key guide parts 12*a* erected thereon and each inserted into an associated one of the black keys 3*a* from below so as to prevent lateral swing of the black key 3*b*. Further, at a location forward of the chassis center 12, there is disposed a hammer support part 15 for supporting the hammers 4. The hammer support part 15 has a plurality of support shafts 15*a* extending along a single straight line extending in the left-right direction, and the hammers 4 are pivotally supported by the support shafts 15*a*, respectively.

Further, between the hammer support part 15 and the chassis front 11, there is mounted the key switch 5. The key switch 5 is comprised of a laterally elongated printed circuit board 5*a* extending in the left-right direction and a plurality of switch bodies 5*b* each formed by a rubber switch and mounted on the printed circuit board 5*a* in association with each key 3.

Figure 3B:
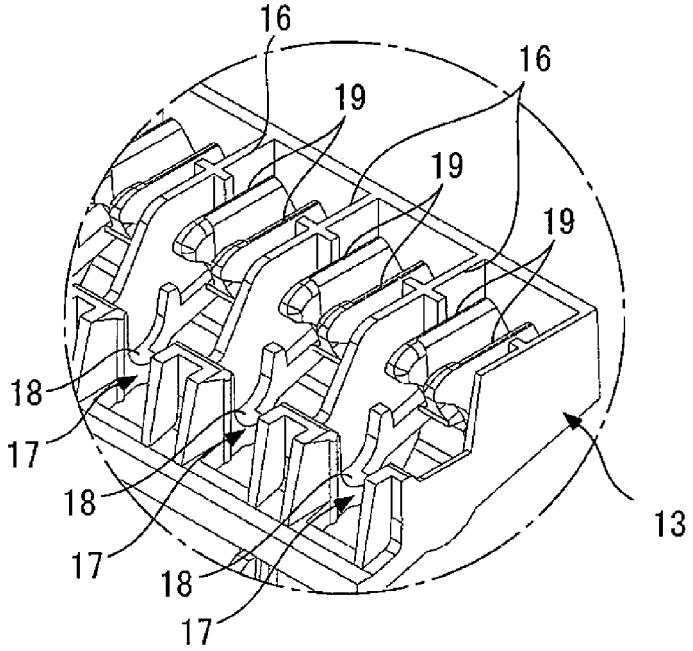
FIG. 3B is an enlarged perspective view of part of a rear end of the keyboard chassis in FIG. 1.

The chassis rear 13 serves to support the keys 3 by their rear ends such that the keys 3 can pivotally move in the vertical direction. As shown in FIG. 3B, the chassis rear 13 is provided with a plurality of partition walls 16 which are formed with a predetermined spacing therebetween in the left-right direction such that adjacent keys 3 and 3 are separated from each other. Further, between each pair of adjacent ones of the partition walls 16, there is formed a predetermined key support part 17 having a laterally symmetrical shape and configured to pivotally support an associated one of the keys 3. Specifically, the key support part 17 has left and right lower support portions 18 and 18 (only the left one of which is shown in FIG. 3B) for supporting, from below, respective left and right pivot shafts 24 and 24, referred to hereinafter, of the key 3, and a pair of left and right upper support portions 19 and 19 for supporting, from above, a portion of a rear end of the key 3 extending from the upper surface of the key 3 to the rear surface thereof.

Figure 4:
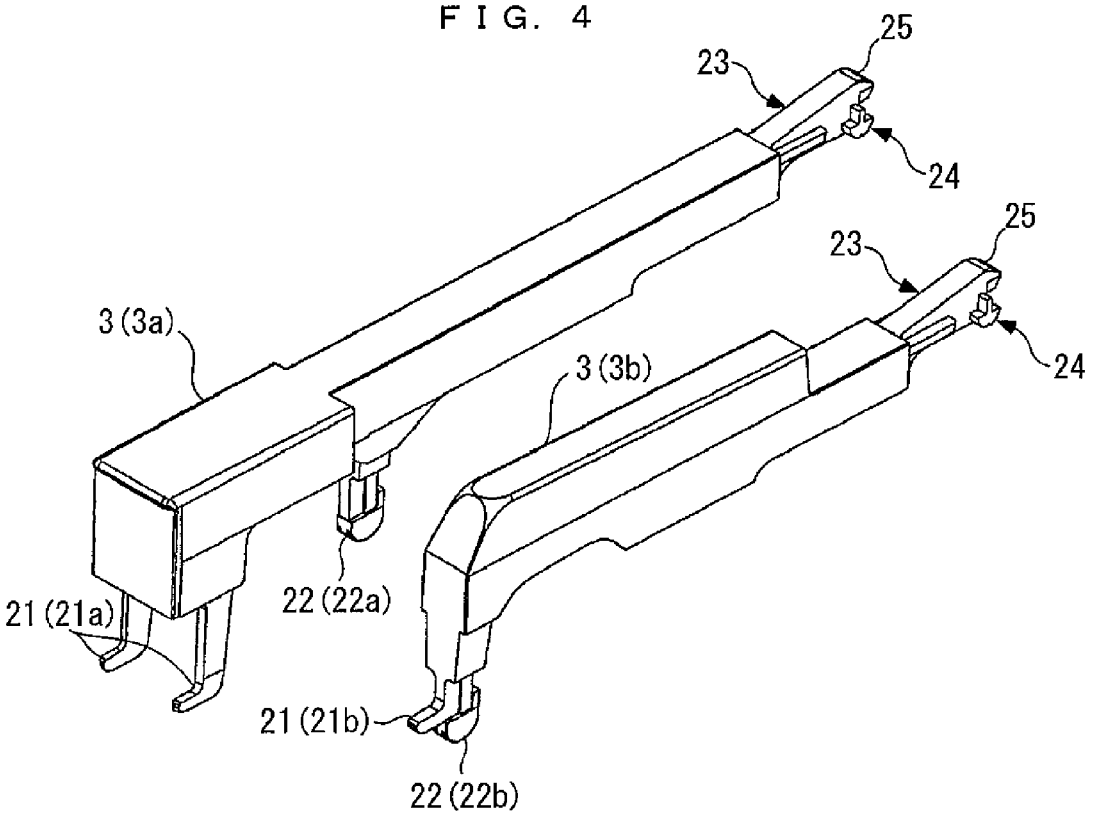
FIG. 4 is a perspective view of a white key and a black key.

The key 3 is formed e.g. by injection molding of a predetermined resin material (e.g. an AS resin) into a hollow shape which extends over a predetermined length in the front-rear direction and opens downward. As shown in FIGS. 3A and 4, the white key 3*a* has a front end thereof formed with the pair of left and right upper limit position regulation parts 21 (21*a*) which extend downward from respective side walls of the front end of the white key 3*a* and each having a lower end thereof bent forward. The upper limit position regulation parts 21 (21*a*) are engaged with the respective left and right engagement holes 11*b* and 11*b* in a state inserted therethrough. Further, the white key 3*a* has an actuator part 22 (22*a*), which projects downward, formed at a predetermined location rearward of the upper limit position regulation parts 21*a*. The actuator part 22 (22*a*) is engaged with an engagement recess 34, referred to hereinafter, of the hammer 4 in a state received therein. On the other hand, the black key 3*b* has a front end thereof formed with an upper limit position regulation part 21 (21*b*) and an actuator part 22 (22*b*), which have the respective same functions as those of the upper limit position regulation parts 21*a* and the actuator part 22*a* of the white key 3*a*.

Figure 5A:
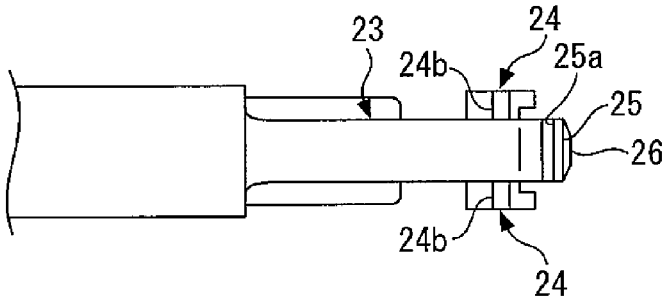
FIG. 5A is an enlarged plan view of a rear portion of the key.
Figure 5B:
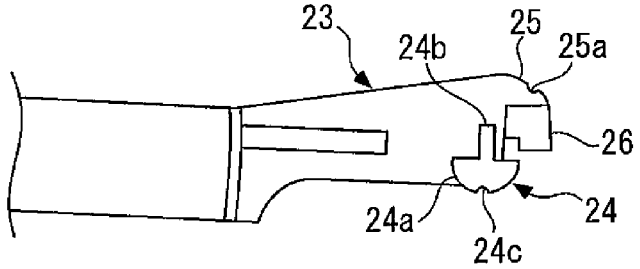
FIG. 5B is an enlarged right side view of the rear portion of the key.

As shown in FIGS. 4, 5A, and 5B, the key 3 has a rear part including a rear body 23 formed such that it has a smaller width than that of part of the key 3 forward thereof and extends in the front-rear direction. The pivot shafts 24 and 24, which protrude outward (i.e. leftward and rightward, respectively), are formed on the left and right side surfaces of the rear body 23 at respective predetermined locations close to a rear end of the rear body 23. Each of the pivot shafts 24 and 24 has a lower half formed as a semicircular portion 24*a* having an arcuate bottom surface and a semicircular side surface, and a protrusion 24*b* protruding upward from the center of the semicircular portion 24*a* in the front-rear direction. Note that the semicircular portion 24*a* of each of the pivot shafts 24 has a groove 24*c* formed in the arcuate bottom surface thereof, such that when lubricant, such as grease, is applied to the arcuate bottom surface of the semicircular portion 24*a*, the grease can be held therein for a long time.

The read end of the rear body 23 is formed such that a curved surface 25 with a predetermined curvature extends from the upper surface to the rear surface of the rear body 23. The curved surface 25 is formed to be convexly curved along a concentric circle about the pivot shaft 24 of the key 3 in side view. Further, the rear end of the rear body 23 has a tapered portion 26 continuous with the curved surface 25 and having a lateral width progressively reduced downward. Note that the curved surface 25 is formed with a groove 25*a* having the same function as that of the groove 24*c* of the pivot shaft 24.

Figure 6A:
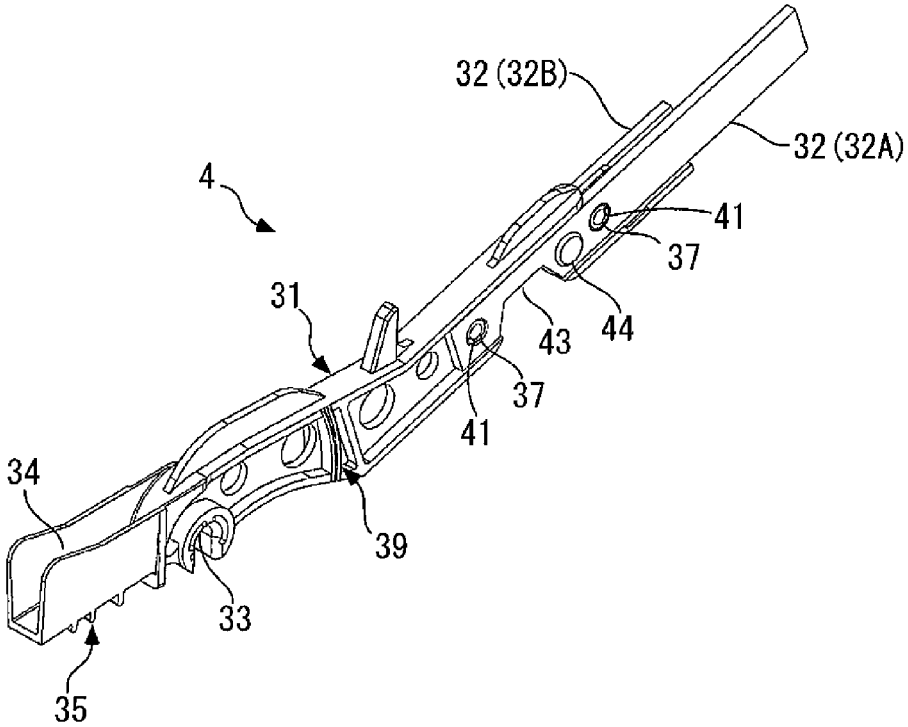
FIG. 6A is a perspective view of the appearance of a hammer.
Figure 6B:
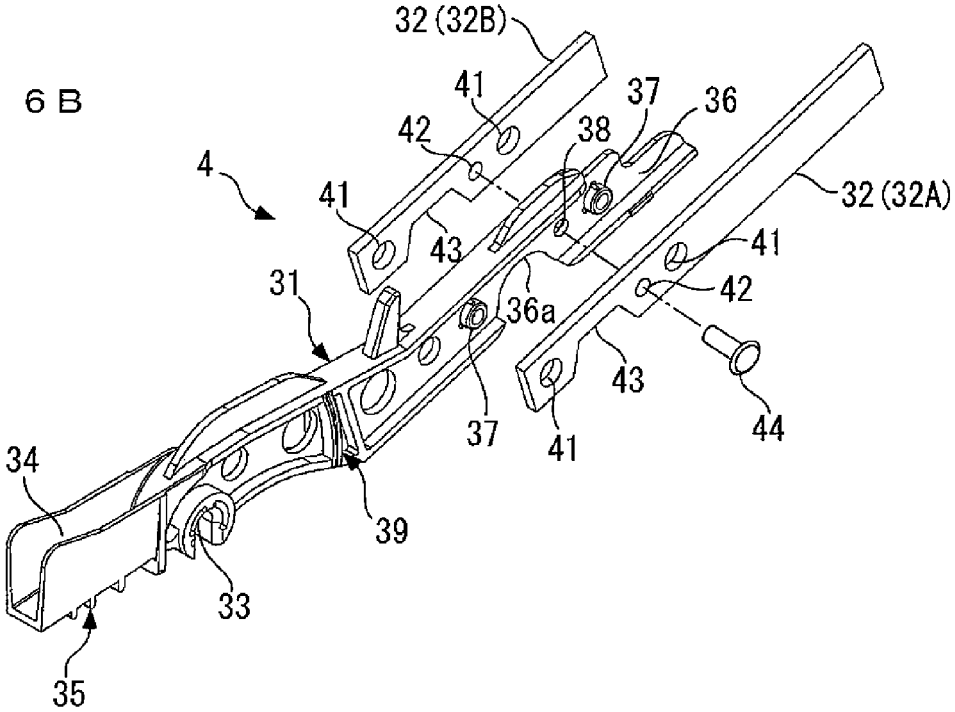
FIG. 6B is an exploded perspective view of the hammer disassembled into a hammer body and weights.

As shown in FIGS. 6A and 6B, the hammer 4 is comprised of a hammer body 31 and two weights 32 and 32 attached to the hammer body 31. The hammer body 31 is formed as a resin molded article which is made e.g. by injection molding of a predetermined resin material (e.g. POM (polyacetal resin)) into a predetermined shape. The hammer body 31 extends over a predetermined length in the front-rear direction and has a bearing portion 33 formed at a predetermined location forward of the center of the hammer body 31 in the front-rear direction. The bearing portion 33 has an inverted U shape open downward in side view and is pivotally engaged with the support shaft 15*a* of the hammer support part 15 of the keyboard chassis 2. The engagement recess 34 for engagement with the actuator part 22 of the key 3 is formed in the front half of the hammer body 31 at a location forward of the bearing portion 33. The engagement recess 34 is open upward and forward, and the lower portion of the actuator part 22 of the key 3 is received in the engagement recess 34 in a state in which a lower end of the actuator part 22 is held in contact with a bottom surface of the engagement recess 34. Further, formed below the engagement recess 34 in the front half of the hammer body 31 are a plurality of switch pressing parts 35 for pressing the switch body 5*b* of the key switch 5.

A weight mounting portion 36 as a rear half of the hammer body 31 has two, i.e. front and rear, pairs of engagement protrusions 37 and 37 formed on the respective left and right side surfaces of the weight mounting portion 36 at predetermined locations, in a manner protruding outward, i.e. leftward and rightward, respectively, from the weight mounting portion 36, and a mounting hole 38 formed at a location close to the rear pair of engagement protrusions 37, in a manner extending through the weight mounting portion 36 in the left-right direction. Note that a cutout 36*a* is formed in a central portion of the weight mounting portion 36 so as to prevent screws and the like that fix the keyboard device 1 to a keybed 10 of an electronic piano (see FIGS. 2A and 2B) from coming into abutment with the hammer 4 when the keyboard device 1 is in the key-released state.

The weights 32 are made of a material (metal such as steel) larger in specific gravity than the hammer body 31, and are formed as two long and narrow plates. Each of the weights 32 is formed in a predetermined shape by pressing a long metal plate having a predetermined thickness and width. Specifically, the weight 32 is formed with two, i.e. front and rear, engagement holes 41 and 41, a mounting hole 42, and a recess 43, which correspond, respectively, to the two engagement protrusions 37 and 37, the mounting hole 38, and the cutout 36*a* formed in the hammer body 31. The two weights 32 and 32 are rigidly secured to the hammer body 31 in a state sandwiching the weight mounting portion 36 of the hammer body 31, by riveting rivets 44 inserted through the mounting holes 42, 42, and 38.

One of the weights attached to each of the hammers 4 (hereinafter referred to as "the common weight 32A") has a predetermined length and is common to all the hammers 4.

On the other hand, the other weight (hereinafter referred to as "the adjustment weight 32B") is formed to have a length equal to or smaller than that of the common weight 32A. Therefore, it is possible to change the weight of the hammer 4 including the two weights 32A and 32B by adjusting the length of the adjustment weight 32B.

In the keyboard device 1 constructed as above, when the key 3 is depressed in the key-released state shown in FIGS. 1 and 2B, the key 3 is pivotally moved downward about the left and right pivot shafts 24 and 24 of the rear end of the key 3. In accordance with this pivotal motion of the key 3, the actuator part 22 of the key 3 presses the engagement recess 34 of the hammer 4 downward. As a consequence, the hammer 4 presses the associated switch body 5*b* of the key switch 5 from above by the switch pressing portion 35 while pivotally moving in the counterclockwise direction, as viewed in FIG. 2B, about the support shaft 15*a* of the hammer support part 15. In this case, the rear end of the hammer 4 (i.e. the rear end of the common weight 32A) is brought into abutment with a hammer stopper 13*a* of the chassis rear 13 from below, whereby further pivotal motion of the hammer 4 is inhibited. By the key depressing operation described above, a predetermined touch weight corresponding to the weight and torque of the hammer 4 is imparted to the key 3, and also key depression information of the key 3 is detected via the key switch 5.

On the other hand, when the depressed key 3 is released, the hammer 4 pivotally moves in the clockwise direction as viewed in FIG. 2B. In accordance with this pivotal motion of the hammer 4, the key 3 is pushed upward via the actuator part 22 and is pivotally moved upward. As a consequence, the key 3 and the hammer 4 return to their key-released state as shown in FIGS. 1 and 2B. In this case, the upper limit position regulation parts 21 of the front end of the key 3 are brought into abutment with a predetermined stopper 20 of the keyboard chassis 2 from below, whereby further pivotal motion of the key 3 is inhibited.

Figure 7:
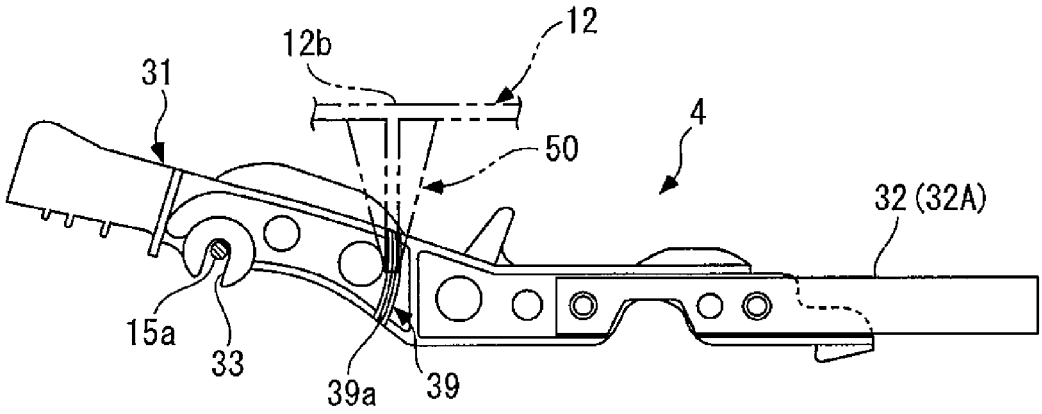
FIG. 7 is a view useful in explaining the relationship between the hammer and the keyboard chassis.

Next, a further detailed description will be given, with reference to FIGS. 6A, 6B, and 7 to 9F, of the hammer device according to the present invention, focusing on the construction of the hammer 4. FIG. 7 shows the hammer 4 and left and right partition parts 50 and 50 (only one of which is shown) provided in the chassis center 12 in a state close to the respective left and right sides (near and far sides as viewed in FIG. 7) of the hammer 4.

The hammer body 31 has left and right opposed protrusions 39 and 39 formed on respective left and right side surfaces thereof at a central location in the front-rear direction. The opposed protrusions are opposed, with a predetermined clearance (e.g. of 0.2 mm), to the left and right partition parts 50 and 50, respectively. Each of the opposed protrusions 39 and 39 is formed in a manner protruding outward of the associated weight 32 over a predetermined length (e.g. 0.5 mm), and arcuately extending along a concentric circle about the pivotal motion support (support shaft 15*a*) of the hammer body 31. Further, each of the opposed protrusions 39 and 39 is formed with a groove 39*a* extending along its lengthwise direction, so that when lubricant, such as grease, is applied to the opposed protrusions 39, the grease can be held therein over a long time period.

Figure 8A:
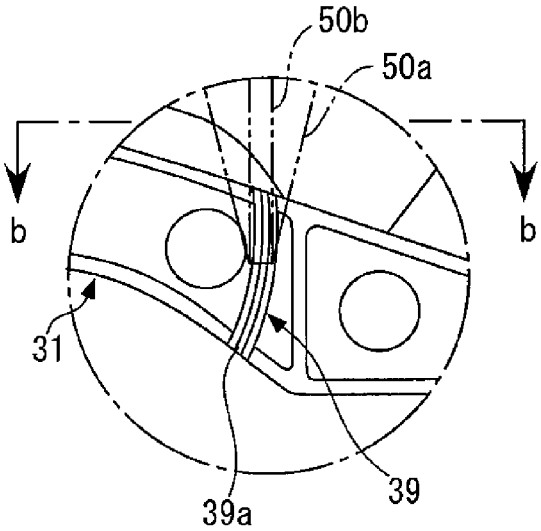
FIG. 8A is an enlarged view of the hammer and a partition part of the keyboard chassis.
Figure 8B:
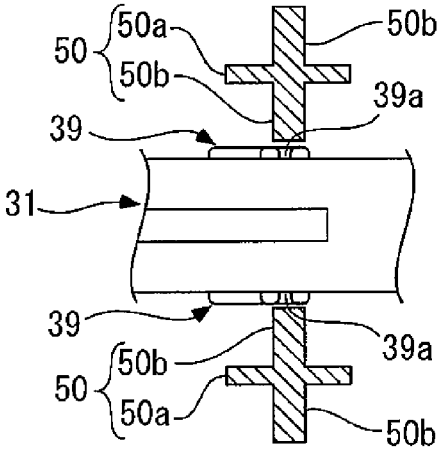
FIG. 8B is a cross-sectional view of the hammer and the partition part of the keyboard chassis taken on line b-b of FIG. 8A.

In the chassis center 12, the partition parts 50 extend vertically from a horizontally flat portion 12*b* of the chassis center 12 in a manner each partitioning between hammers 4 and 4 adjacent to each other in the left-right direction (see FIG. 3A). As shown in FIGS. 7, 8A, and 8B, each of the partition parts 50 is comprised of a partition wall 50*a* having a predetermined thickness in the left-right direction (near-far direction as viewed in FIGS. 7, 8A, and vertical direction as viewed in FIG. 8B) and a guide protrusion 50*b* extending vertically along the left and right side walls of the partition wall 50*a* and protruding toward associated one of the hammers 4. In the key-released state shown in FIG. 7, an upper portion of the opposed protrusion 39 of the hammer 4 is opposed to a lower end of the guide protrusion 50*b* of the partition part 50 via the clearance, as shown in FIGS. 8A and 8B.

Further, the common weight 32A is common to all the hammers 4, as mentioned hereinbefore, and therefore all the common weights 32A are identical in shape and size to each other. On the other hand, each of the adjustment weights 32B has its length in the front-rear direction set differently according to a touch weight required by the associated key 3. Specifically, the adjustment weights 32B for the hammers 4 associated with the respective keys 3 in a lower-pitch range are formed to be longer, while the adjustment weights 32B for the hammers 4 associated with the respective keys 3 in a higher-pitch range are formed to be shorter.

Figure 9A:
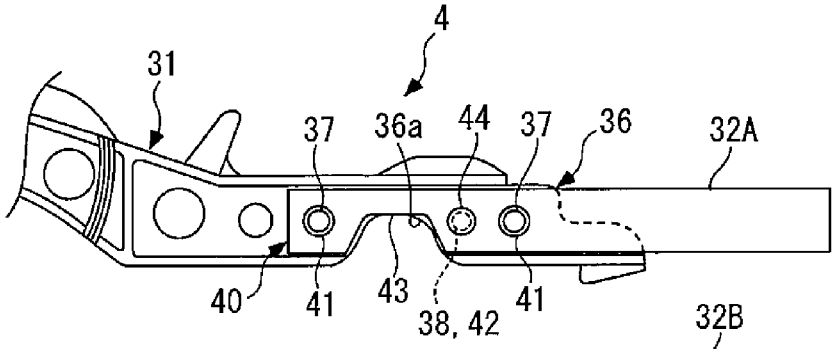
Figure 9B:
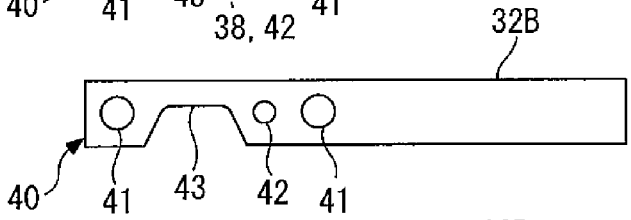
Figure 9C:
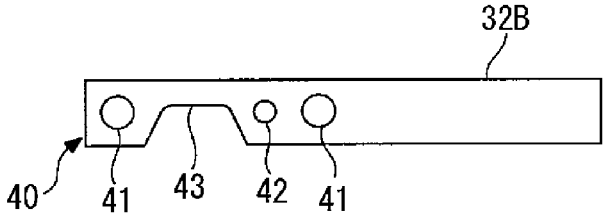
Figure 9D:
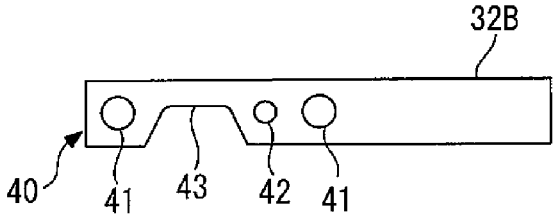
Figure 9E:
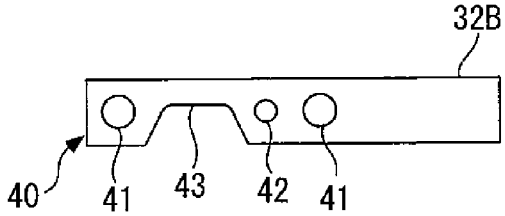
Figure 9F:
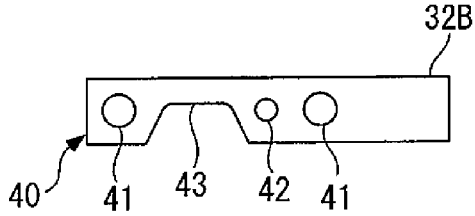

FIG. 9A shows the common weight 32A (first weight) attached to the hammer body 31, and FIGS. 9B to 9F show respective adjustment weights 32B (second weights) different in length from each other. As shown in FIGS. 9A to 9F, each of the common weight 32A and the adjustment weights 32B has a common mounted portion 40 to be mounted to the weight mounting portion 36 of an associated one of the hammer bodies 31. More specifically, the common mounted portion 40 of each of all the weights 32A and 32B is formed with two engagement holes 41 and 41, a mounting hole 42, and a recess 43 which correspond, respectively, to the two engagement protrusions 37 and 37, the mounting hole 38, and the cutout 36*a* formed in the hammer body 31, and the two engagement holes 41 and 41, the mounting hole 42, and the recess 43 are common in shape and position to all the weights 32A and 32B.

Therefore, when manufacturing the common weight 32A and the adjustment weight 32B, a long metal plate having the same thickness and width as those of each weight 32 to be manufactured is prepared. Then, the common mounted portion 40 is formed in the metal plate e.g. by presswork, and the metal plate is cut into a desired length, whereby it is possible to manufacture the common weight 32A and the adjustment weight 32B with relative ease.

As described above in detail, according to the present embodiment, the common weight 32A and the adjustment weight 32B are attached to the hammer body 31, whereby more than half of weight required of the hammer 4 is provided by the common weight 32A and the weight is adjusted by the adjustment weight 32B. The common weight 32A is common in length to all the hammers 4, so that when any of the hammers 4 is pivotally moved, the trajectory of the rear end of the common weight 32A thereof forms the same path. This makes it possible to dispose the hammer stopper 13*a* in the chassis rear 13 of the keyboard chassis 2 in a manner extending along a single straight line in the left-right direction, to thereby obtain a stable pivot angle when the hammer 4 is pivotally moved in a manner interlocked with depression of the associated key 3. Further, the adjustment weight 32B has its weight adjusted by setting its length in the front-rear direction as desired. Therefore, differently from the prior art in which weights having a complicated external shape are used, it is possible to improve manufacturing efficiency and yield concerning the two weights 32A and 32B attached to each hammer body 31 while suppressing an increase in manufacturing costs. Further, since the mounted portion 40 of the common weight 32A and that of the adjustment weight 32B, which are to be attached to the weight mounting portion 36 of the hammer body 31, are formed to be identical in construction to each other, it is possible to efficiently form the mounted portions 40 using a single mold or the like.

Further, according to the present embodiment, the left and right opposed protrusions 39 and 39 of the hammer 4 protrude outward, i.e. leftward and rightward, respectively, and each of the left and right opposed protrusions 39 and 39 is opposed via a predetermined clearance to the guide protrusion 50*b* of the associated partition part 50 of the keyboard chassis 2. As a consequence, when the hammer 4 is brought into abutment with the partition part 50 e.g. due to deformation of the keyboard chassis 2, the opposed protrusion 39 protruding outward from the hammer body 31 comes into abutment with the partition part 50, with precedence over the weights 32, which makes it possible to avoid abutment of the weight 32 of the hammer 4 against the keyboard chassis 2. This makes it possible to prevent generation of noise due to abutment of the weight 32 of the hammer 4 against the keyboard chassis 2 while ensuring smooth pivotal motion of the hammer 4. Further, it is not required to wind guide tapes around the respective weights 32 of the hammer 4 as in the prior art, so that reduction of manufacturing cost can be achieved. Furthermore, each of the opposed protrusions 39 has an arcuate shape in side view, which extends along a concentric circle about the pivotal motion support of the hammer body 31, so that even when the opposed protrusion 39 is brought into sliding contact with the guide protrusion 50*b* of the keyboard chassis 2 during pivotal motion of the hammer 4, it is possible to reduce a frictional force generated between the two, to thereby ensure smooth pivotal motion of the hammer 4.

Note that the present invention is by no means limited to the embodiment described above, but it can be practiced in various forms. For example, although in the present embodiment, the hammer device of the present invention is applied to the keyboard device of the electronic piano, the hammer device can also be applied to another keyboard instrument, such as an electronic organ. Further, the construction of the weight mounting portion 36 of the hammer body 31 and that of the mounted portion 40 of the weight 32 are not particularly limited, but it is possible to form the weight mounting portion 36 and the mounted portion 40 into various shapes insofar as the weight 32 can be attached to the hammer body 31. Furthermore, the position and shape of each of the left and right opposed protrusions 39 and 39 of the hammer 4 are not particularly limited, either, but any position or shape can be adopted insofar as it is possible to prevent the side surface of the weight 32 from rubbing against the keyboard chassis 2 during pivotal motion of the hammer 4.

Further, the details of the construction of each of the hammer body 31, the common weight 32A, and the adjustment weight 32B of the hammer 4, the partition part 50 of the keyboard chassis 2, and so forth described in the embodiment are given only by way of example, and various changes and modifications may be made without departing from the spirit and scope of the present invention.

What is claimed is:

1. A hammer device for a keyboard instrument, which includes a plurality of hammers each provided in association with an associated one of a plurality of keys, and in which each of the hammers is pivotally moved in a manner interlocked with depression of the associated key to thereby impart touch weight to the key, wherein each of the hammers comprises:

a hammer body extending in a front-rear direction, said hammer body having a front half thereof pivotally supported and a rear half thereof formed with a weight mounting portion;

a first weight extending in the front-rear direction, said first weight being formed common in shape and size to all the hammers, and attached to one of left and right side surfaces of the weight mounting portion; and a second weight extending in the front-rear direction, said second weight being formed to have a length in the front-rear direction which is shorter than a length in the front-rear direction of said first weight and is set according to a touch weight required by the associated key, and attached to the other of the left and right side surfaces of the weight mounting portion.

2. The hammer device according to claim 1, wherein said first weight and said second weight have respective mounted portions formed to be identical in construction to each other and attached to the weight mounting portion of said hammer body.

3. The hammer device according to claim 2, wherein said first weight and said second weight are formed by respective metal plates identical in thickness and width to each other.

4. A hammer device for a keyboard instrument, which includes a plurality of hammers each provided in association with an associated one of a plurality of keys, and is pivotally supported on a chassis in a state arranged side by side in a left-right direction, and in which each of the hammers is pivotally moved in a manner interlocked with depression of the associated key to thereby impart touch weight to the key, wherein the chassis is formed as a molded article which is made of a synthetic resin, and has a plurality of partition parts each provided between each pair of hammers adjacent to each other in the left-right direction, and wherein each of the hammers comprises:

a hammer body formed as a molded article which is made of a synthetic resin and extends in a front-rear direction, and is pivotally supported on the chassis via a support formed at a predetermined location of a front half thereof; and a weight extending in the front-rear direction, said weight being attached to a rear half of said hammer body, and wherein on left and right side surfaces of said hammer body, there are formed, between the support and said weight, left and right opposed protrusions which protrude outward of the weight and are each opposed to an associated one of the partition parts via a predetermined clearance.

5. The hammer device according to claim 4, wherein each of the opposed protrusions is formed in an arcuate shape in side view, which extends along a concentric circle about the support.

6. The hammer device according to claim 5, wherein each of the opposed protrusions is formed with a groove for retaining lubricant.

* * * * *